United States Patent [19]

Kawabe

[11] 4,334,670

[45] Jun. 15, 1982

[54] ANCHOR WINCH EQUIPMENT

[75] Inventor: Motoyuki Kawabe, Onomichi, Japan

[73] Assignee: Taiyo Sengu Co., Ltd., Japan

[21] Appl. No.: 112,675

[22] Filed: Jan. 16, 1980

[30] Foreign Application Priority Data

Jan. 17, 1979 [JP] Japan ..... 54-4106

[51] Int. Cl.[3] ..... B65D 1/14

[52] U.S. Cl. ..... 254/346; 242/99; 254/272; 254/378; 254/392; 254/397; 254/413

[58] Field of Search ..... 254/362, 346, 355, 366, 254/378; 242/84.1 A, 84.52 A, 218, 99

[56] References Cited

U.S. PATENT DOCUMENTS

| | | | |
|---|---|---|---|
| 1,314,660 | 9/1919 | Huber et al. | 254/378 |
| 1,426,594 | 8/1922 | Oltsch | 242/84.52 A |
| 2,700,531 | 1/1955 | Patterson, Jr. | 254/346 |
| 2,977,065 | 3/1961 | Holahan, Jr. | 242/218 |
| 4,084,793 | 4/1978 | Gardiner | 254/362 |
| 4,196,871 | 4/1980 | Kobayashi | 242/84.52 A |

*Primary Examiner*—Billy S. Taylor

*Attorney, Agent, or Firm*—William A. Drucker

[57] ABSTRACT

Anchor winch equipment, for a motor boat, a yacht or a small-sized fishing boat, which ensures easy and simple paying out and hauling in of an anchor and whose power is supplied from a battery or a generator provided in said boat or yacht, is characterized in that when a drive motor built in a drum rotates in the winding direction, a changeover ratchet wheel having a drive pawl at one end transmits rotation to a drum and a feed cam shaft by means of a roller clutch fitted by a screw provided at the outer periphery of main shaft linked with motor shaft, causing the anchor rope to be wound in the same time when said drum begins to rotates, and a feed cam shaft simultaneously rotate to cause said anchor rope to be gradually wound along the surface of said drum, and that in the case of reverse of direction, said changeover ratchet wheel is immediately disengaged by means of said pawl and only said roller clutch moves together with said main shaft, both said drum and said feed cam shaft being disengages from said main shaft as a fixed ratio of rotation is kept therebetween, thereby permitting said drum to unwind an anchor rope by free rotation under the weight of an anchor mounted at the end of said anchor rope, and as the strain on said anchor rope is lessened when said anchor reaches the sea bottom, a band brake mounted at a side of said drum operates to instantly stop said drum by lowering of an operating weight suspended from said rope.

2 Claims, 8 Drawing Figures

ANCHOR WINCH EQUIPMENT

BACKGROUND OF THE INVENTION

As almost all the conventional anchor winches for use in a motor boat, a yacht or a small-size fishing boat have hitherto been of manual type, they require troublesome operation. Recently such winches have been provided with an electric motor to ensure automatic operation by manipulating a switch. However, in these anchor winches, an electric motor is placed outside the winding drum and these anchor winches themselves become large, and need large installation space. Furthermore, the electric motor and the linkage mechanism from the electric motor are apt to be badly influenced by sea water.

OBJECTS OF THE PRESENT INVENTION

One of the primary important objects of the present invention is to make the whole anchor winch system compact.

Another important object of the present invention is to protect an electric motor and the linkage mechanism between motor and winch body from the ill-effect of salt of sea water.

A further important object of the present invention is to provide a mechanism by which an anchor rope can be regularly wound on a winding drum as an electric motor begins to rotate when hauling in, and said rope can be quickly paid out and said winding drum is automatically braked to cause said drum to stop when said anchor reaches the sea bottom accordingly to prevent excessive paying out of anchor rope.

These and other objects are accomplished by the parts, improvements, combinations and the arrangements comprising the invention, a preferred embodiment of which is shown by way of example in the accompanying drawings, and herein described in detail. Various modifications and changes in details of construction are comprehended within the scope of the appended claims.

DESCRIPTION OF THE PREFERRED EMBODIMENT

Figure 1:
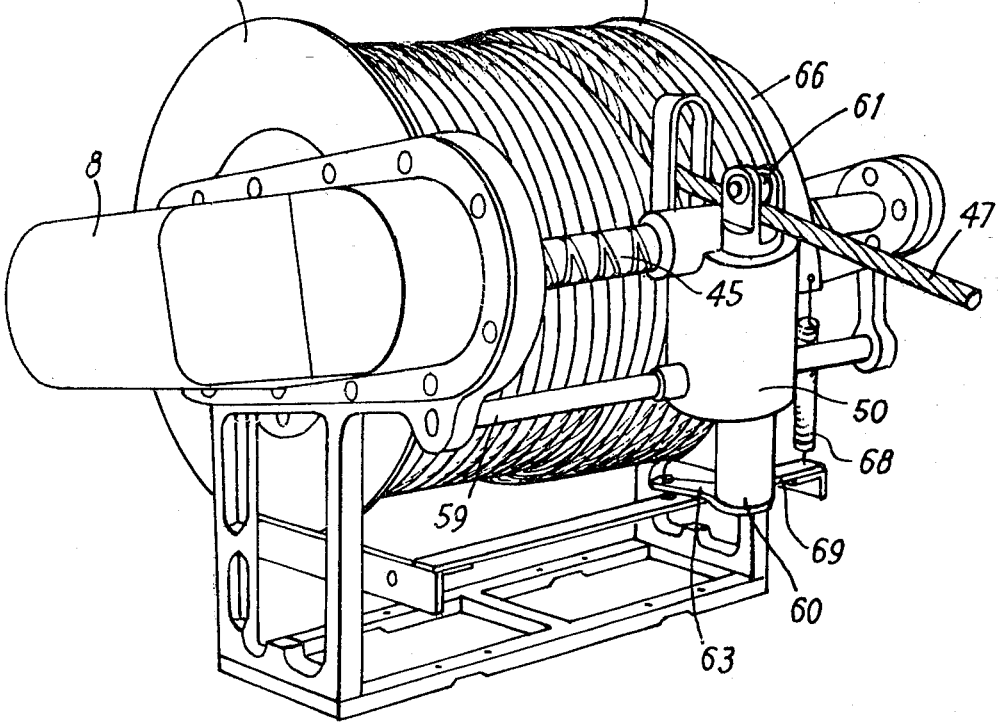
FIG. 1 is a perspective view of the whole anchor winch equipment disclosed by the present invention.
Figure 8:
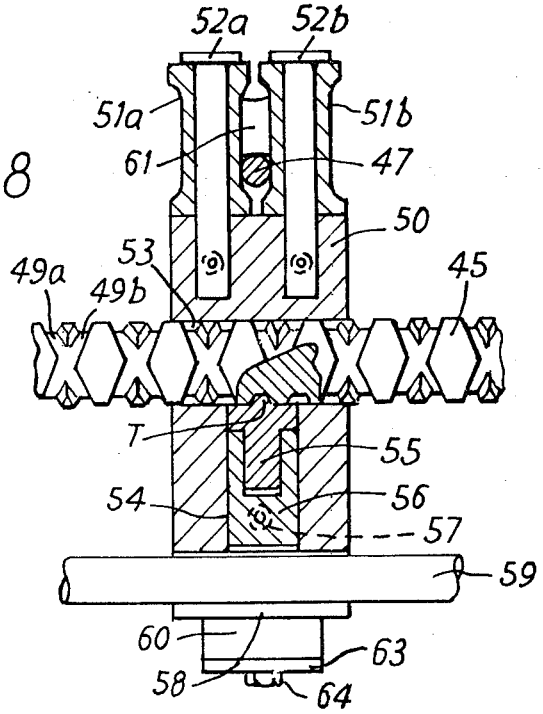
FIG. 8 is a longitudinal sectional view taken along the line VIII—VIII of FIG. 2.
Figure 2:
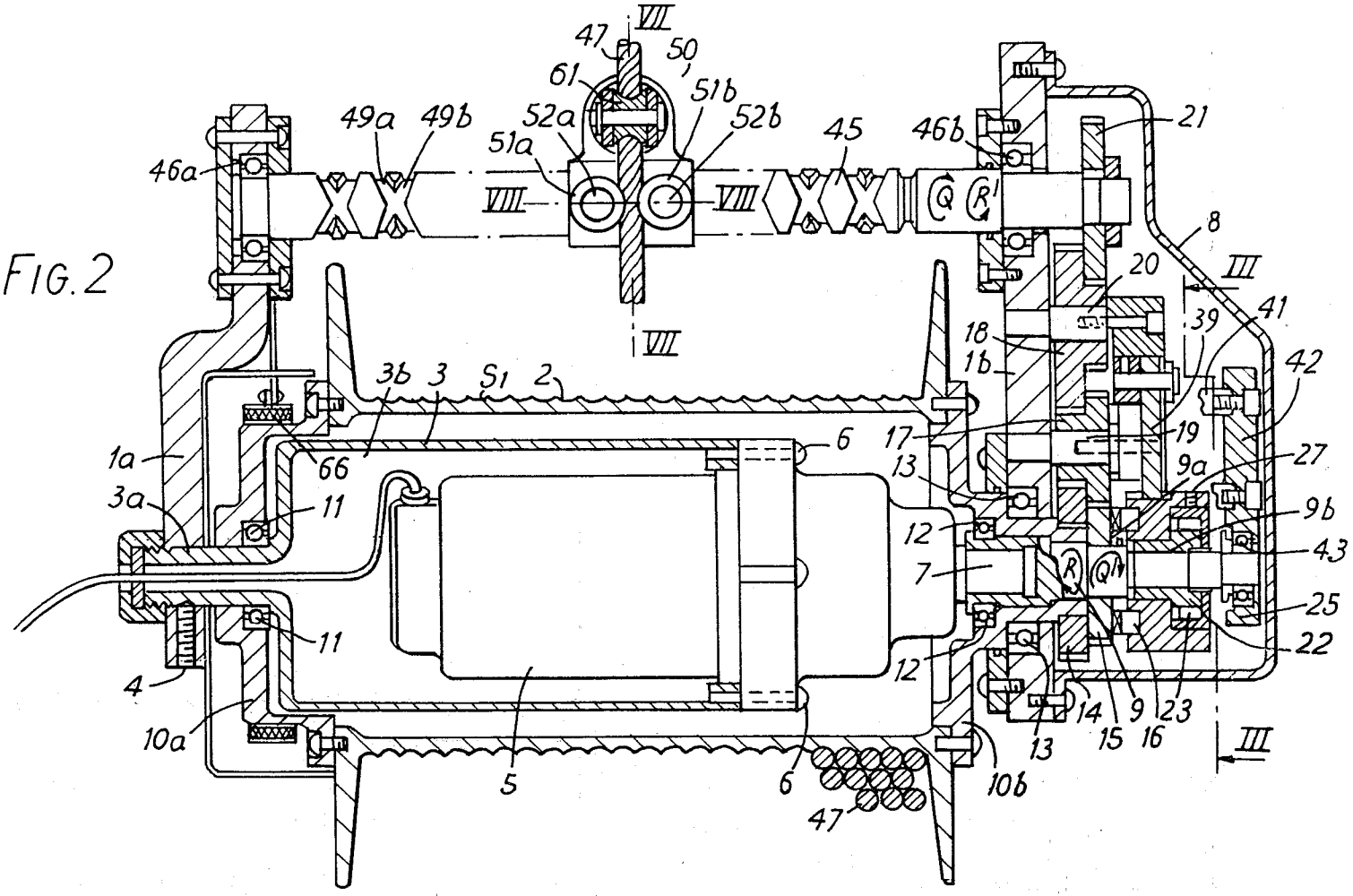
FIG. 2 is a plan view of the anchor winch equipment.
Figure 3:
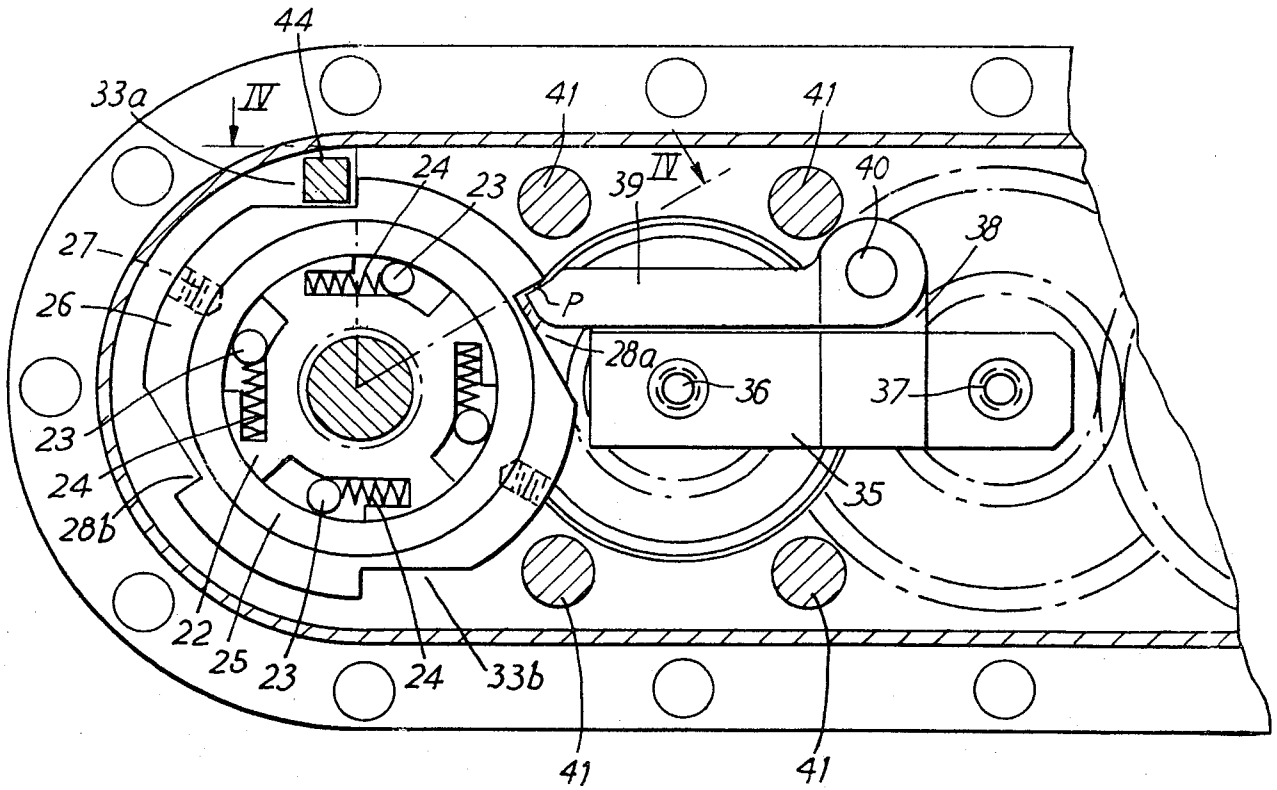
FIG. 3 is a longitudinal sectional view taken along the line III—III of FIG. 2.
Figure 4:
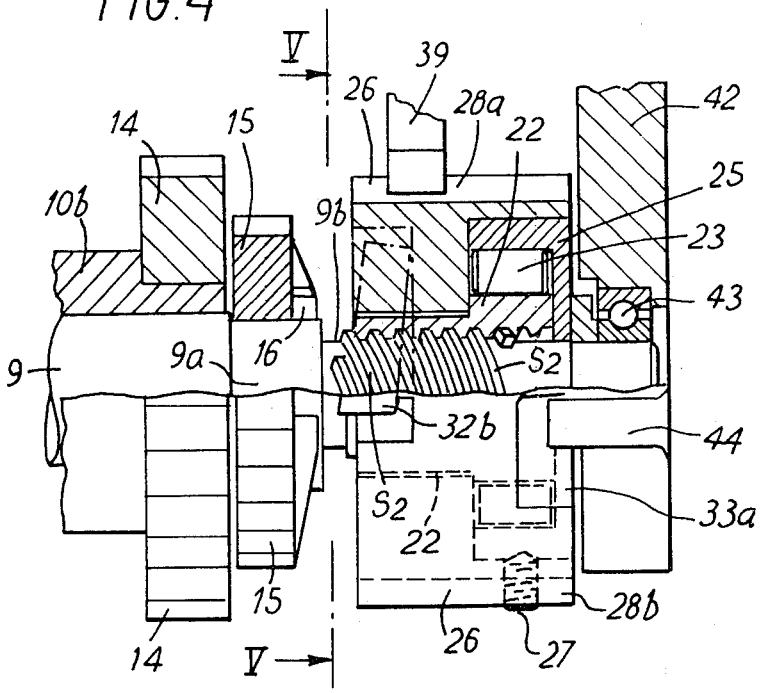
FIG. 4 is a lateral sectional view taken along the line IV—IV of FIG. 3.
Figure 5:
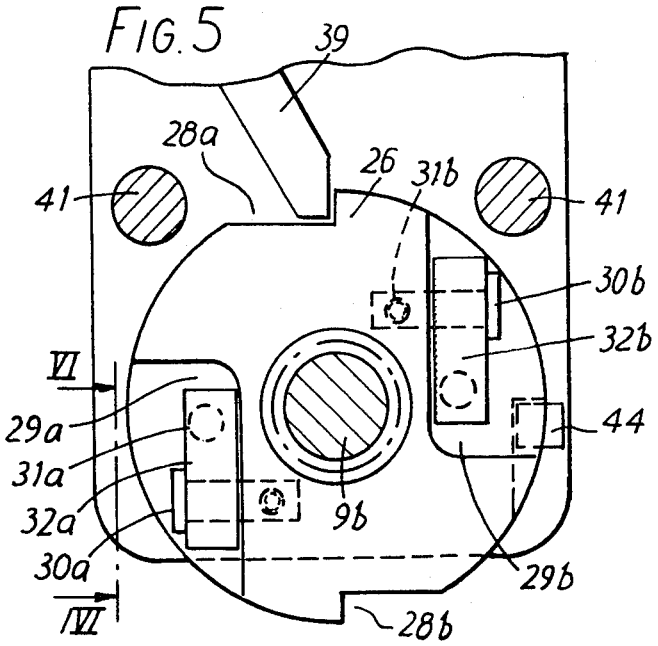
FIG. 5 is a longitudinal sectional view taken along the line V—V of FIG. 4.
Figure 6:
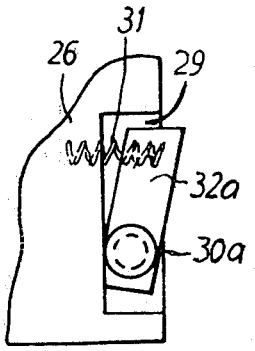
FIG. 6 is a partially sectional view taken along the line VI—VI in FIG. 5.

Referring to FIGS. 1 and 2, side wall frames of a preferred embodiment of the present invention are indicated at 1*a* and 1*b*, between which a winding drum 2 (hereinafter merely called "drum") is provided, the surface of which is machined to be of spiral grooves S1 suitable for the shape of an anchor rope. Said drum is rotatably supported by a main shaft 9. A motor casing is indicated at 3. The nose part 3*a* of said motor casing is fixed and locked by a set screw 4 in said side wall frame 1*a*. An electric motor 5 is inserted in a casing body 3*b* from open end thereof and is fixed by screws 6. A drive shaft 7 of said motor 5 is rotatably supported in said side wall frame 1*b* via a side wall flange hereinafter described in detail, and the end of said drive shaft 7 is linked as one unit with said main shaft 9 provided in a gear box 8. Flanges of said drum 2 are indicated at 10*a* and 10*b*. Said flange 10*a* is rotatably placed on the nose part 3*a* of said motor casing 3 by way of a bearing 11. Said flange 10*b* is also rotatably placed on said side wall frame 1*b* in relation to said main shaft 9 by way of bearings 12 and 13. In addition, the top of said flange 10*b* is linked together with a gear 14 in said gear box 8.

The gears mechanism inside said gear box 8 is disclosed in the following description. Said main shaft 9 consists of 9*a* and 9*b*. A ratchet gear 15 is rotatably placed on said main shaft 9*a* and ratchet teeth project from a side of said ratchet gear. Intermediate gears 17 and 18 are formed to be of two stages. Each of these intermediate gears 17 and 18 is supported on said side wall frame 1*b* by means of pins 19 and 20, respectively, thereby transmitting the rotation of said ratchet gear 15 to a gear 21 fixed on a feed cam shaft hereinafter described in detail.

Referring to FIGS. 2, 3, 4, and 5, the periphery of said main shaft 9*b* is provided with a helical groove S2 on which a roller clutch 22 is placed for engagement therewith. 23 is a roller, 24 is a spring which resiliently urges, said roller 23, 25 is a roller housing and 26 is a changeover ratchet wheel which is linked with said roller housing 25 by means of a set screw 27. Said changeover ratchet wheel 26 is provided with two notches 28*a* and 28*b*, which are formed at diametrically opposite points of said wheel 26.

One of these notches 28*a* and 28*b* is engaged by a pawl hereinafter described in detail if said changeover ratchet wheel 26 tends to rotate in a particular direction. Namely, in the illustrations shown in FIG. 3, said wheel and said pawl are so constructed that they may stop the clockwise rotation of said wheel 26 when it tends to rotate in that direction.

On the other hand, 29*a* and 29*b* are also notches which are formed so that they may be opposed to said pawl of said changeover ratchet wheel 26. Both notches 29*a* and 29*b* are provided with drive ratchets 32*a* and 32*b* so constructed that they may be always projected toward said ratchet gear 15 by means of push springs 31*a* and 31*b*. At this time, pins 30*a* and 30*b* are fulcra permitting the projecting movements of said drive pawls 32*a* and 32*b*.

On the opposite side of said drive pawls 32*a* and 32*b* of said changeover ratchet wheel 26, two notches 33*a* and 33*b* are formed at diametrically opposite points. One of these notches 33*a* and 33*b* is caught by a stop member described later if said changeover ratchet wheel 26 tends rotate in a particular direction. Namely, in the illustration shown in FIG. 3, said wheel is so constructed that it may be stopped by means of said stop member when said wheel 26 tends to rotate in counterclockwise direction in the case of FIG. 3.

35 is a ratchet holder which is fixed by set screws 36 and 37 at the top of said lock pins 19 and 20 of said intermediate gears 17 and 18. A bearing 38 which is located on said ratchet holder 35 serves to mount and rotate a pawl 39 by means of a pin 40. The end "P" of said pawl 39 is projected towards said changeover ratchet wheel 26. Said wheel 26 and said pawl 39 are so constructed that said pawl 39 may slip over said notches 28*a* and 28*b* when said wheel rotates in counterclockwise direction and may stop said wheel 26 by being engaged with said notches 28*a* and 28*b* when said wheel 26 rotates in clockwise direction.

Four columns 41 projects from said side wall frames 1*b* in said gear box 8 and firmly support a bearing plate 42. Said bearing plate rotatably supports the end of said main shaft 9 by means of a ball bearing 43 and is provided with said stop member 44 so that it may project towards said changeover ratchet wheel 26.

45 is a feed cam shaft, one end of which is supported by means of a bearing 46*a* on said side wall frame 1*a* and the other end of which is also supported by means of another bearing 46*b* on said side wall frame 1*b*. Said feed cam shaft 45 is used regularly to wind or draw out a rope 47, which consists of hemp or nylon, on said drum 2. The rotation and movement of said feed cam shaft 45 are effected by transmitting the rotation of said ratchet gear 15 by means of said intermediate gears 17 and 18 to said gear 21 integrally mounted therewith in said gear box.

Referring to FIGS. 7 and 8, 49*a* and 49*b* are helical grooves, whose feed direction is different, so formed on said feed cam shaft that a shifter 50 is guided in said helical grooves. Said shifter is so constructed that it is provided with a pair of rollers 51*a* and 51*b* rotatably mounted thereon by means of pins 52*a* and 52*b*, respectively, thereby causing said rope 47 to be placed between rollers 51*a* and 51*b* for easy and secure leading. A through hole in which said feed cam shaft is inserted is made at the center part of the said shifter 50 and another hole 54 is formed in a perpendicular direction from the opposite side (the underside of the shifter) of said rollers 51*a* and 51*b*. A guide key 55 is inserted in said hole 54 first. Subsequently, a bushing 56 which supports said guide key 55 is also inserted in said hole 54. Said bushing 56 is fixed by set screw 57 with respect to the body of said shifter so that a projected top end "T" of said guide key 55 may be inserted and positioned in said helical grooves 49*a* and 49*b*.

A slit, in which a guide rod 59 mounted between said side wall frames 1*a* and 1*b* is inserted, is also formed in parallelism with said hole 53 at the lower side of said shifter body.

Figure 7:
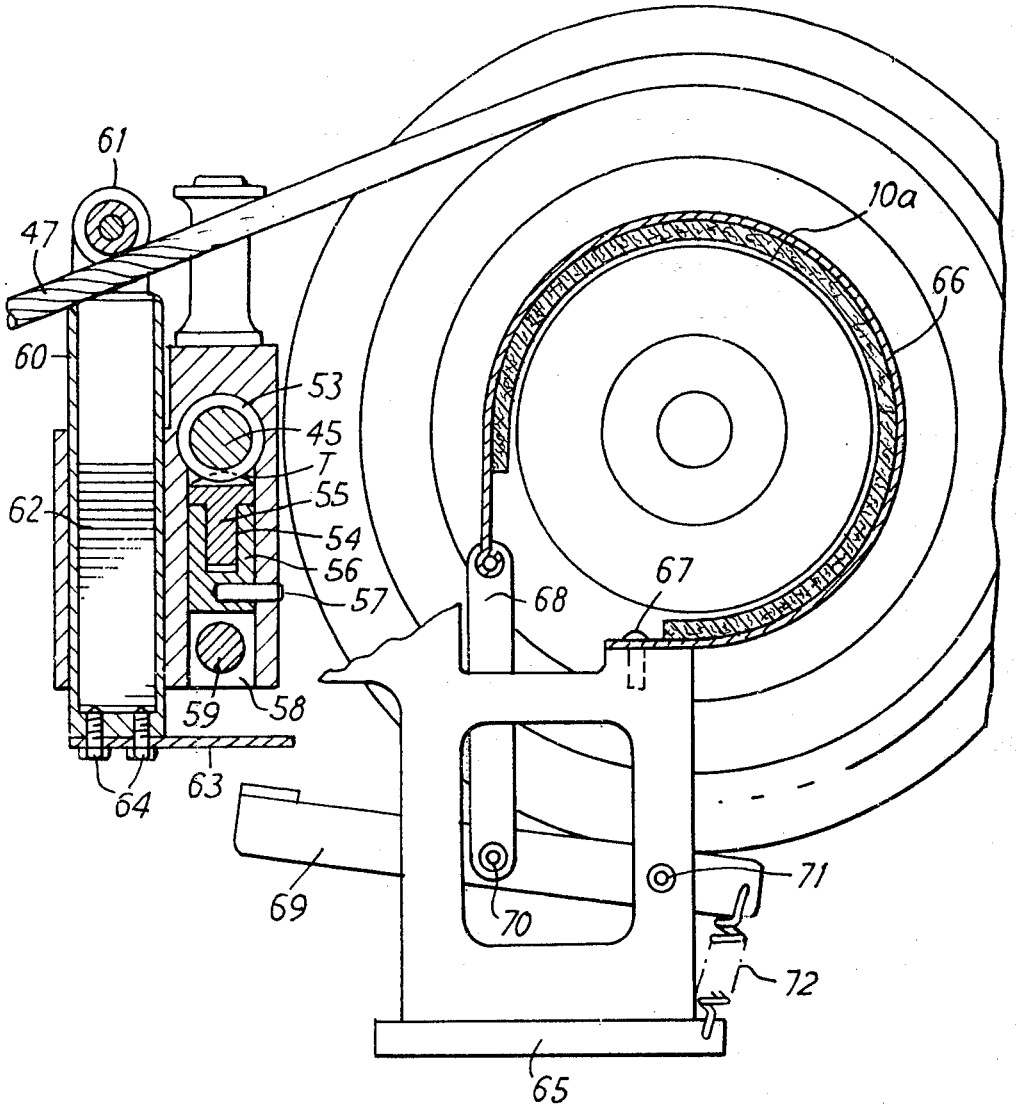
FIG. 7 is a longitudinal sectional view taken along the line VII—VII of FIG. 2.

At the front side of said shifter body 50, a suspension cylinder 60 is mounted slidably in vertical direction, and is provided with a horizontally mounted block 61, which is freely rotatable, at the top thereof. Said suspension cylinder 60 is also provided with a balance weight 62. In addition, an arm 63 is mounted by setscrews 64 at the underside of said suspension cylinder and extends toward said drum. Under these conditions, a rope 47 is passed through said block 61. If said rope 47 is strained, said suspension cylinder is raised (elevated) as shown in FIG. 7, overcoming said balance weight 62.

A band brake 66 is provided from the winch base 65 on said side wall flange 10*a* of said drum 2 in a winch equipment of the present invention.

One end of said brake 66 is fixed by set screw 67 at the upper part of said winch base 65 and the other end is fixed via a linkage plate 68 at a half way point of a brake lever 69 by means of a pin 70.

The end of said brake lever 69 extends toward said shifter 60 and the rear end of said brake lever is rotatably fixed by means of pins 71 on said winch base 65. A spring 72 is provided between said brake lever 69 and said winch base 65 and urges said lever 69 upwardly so that said band brake 66 is usually non-actuated.

Next, practical operation is described in detail below. When the electric motor 5 is started in normal direction (namely in the direction "R" shown by arrow in the illustration) by manipulating the operating switch (not seen in the Figures), the rotation of said motor 5 moves leftwards said changeover ratchet wheel 26 located on the main shaft 9*b*, the rotation of said wheel 26 being interrupted by said stop member 44 projecting from said bearing plate 42. Said changeover ratchet wheel 26 begins to rotate, separating from said stop member as soon as said drive pawls 32*a* and 32*b* come into engagement with the ratchet teeth 16 of said ratchet gear 15, the rotation of said main shaft 9 being transmitted to said gear 21 of said feed cam shaft 45 by way of said intermediate gears 17 and 18 and said feed cam shaft 45 being rotated in the direction Q shown by an arrow.

At this time, as said intermediate gear 17 is of two stages as already described and the teeth of the lower stage of the gear 17 becomes engaged with said gear 14 integrally fixed with said side wall flange 10*b* of said drum, the winding speed of said drum 2 is reduced, thereby causing the rotation torque to be increased. Therefore, said rope 47 is wound on the surface of the drum 2. To the contrary, the rotation and movement of said feed cam shaft 45 in said Q direction let said shifter 50 located on said feed cam shaft 45 move in both right and left directions as guided by said helical grooves 49*a* and 49*b*, said rope 47 being thereby regularly wound on said drum 2 in good order.

On the other hand, if the motor rotation is reversed by manipulating the operating switch (not seen in Figures), the main shaft 9 then rotates in the direction "Q'" and said changeover ratchet wheel 26 moves rightwards with the rotation of said wheel 26 being interrupted by said pawl 39 engaged in either notch 28*a* or 28*b* provided on the periphery thereof, said wheel 26 being thereby separated from said ratchet gear 15. Contrarily, said stop member 44 is then inserted in one of the notches 33*a* and 33*b* and said wheel stops accordingly. If the rotation of the main shaft is continued, said roller 23 rolls over against said spring 24 and said roller clutch 22 loses frictional transmission force with said roller housing 25, thereby causing said roller clutch to idly rotate together with said main shaft.

As soon as said changeover ratchet wheel 26 is separated from said gear 15, said drum 2 can keep a fixed ratio of rotation in relation to said feed cam shaft 45 by means of gears, thereby causing said drum to draw out said rope 47 at a revolution speed proportionate to a force generated by a self-weight of an anchor mounted at the end of said rope 47. At this time, said rope is usually drawn out through a line arranger (rope leader) separately installed on a deck of a boat, which is mounted linearly in relation to the drum 2.

In an embodiment of the present invention, the suspension cylinder 60 is provided at the front side of the shifter 50. When said block 61 located on the top of said suspension cylinder is floated by tension of said rope 47, said suspension cylinder 60 slides in vertical direction according to the tension or loosening of said rope 47 because said suspension cylinder is well controlled by the tension of the rope (weight of anchor) and balance weight 62 built therein. Therefore, when the tension of said rope 47 is lost as an anchor reaches the sea bottom, said suspension cylinder drops to cause said arm 63 to come into contact with said brake lever 69, thereby causing said band brake to be actuated. Here, said drum 2 can instantly stop. Therefore, though the drawing out speed of said drum is accelerated as said rope is being drawn out, it can instantly stop as soon as the rope 47 is loosened. So, excessive drawing out can be effectively prevented.

Furthermore, in case of winding up, said suspension cylinder 60 is elevated as tension is produced, and said brake lever 69 is made free from any load. Then, it is lifted upwards by means of said spring 72, causing the band brake 66 to be loosened. Therefore, said drum 2 begins to rotate as said electric motor rotates. All the above operations can be completely controlled by manipulating the operating switch (not seen in Figures).

On the contrary, said drum 2 is released from said motor by reversing the operating switch in the case of drawing out an anchor and it can freely rotate in conformity with the speed of dropping of the anchor mounted at the end of the rope. As soon as the anchor reaches the sea bottom, the drum can instantly stop, thereby causing the winding condition on the drum not to be disordered.

After drawing out, if the operating switch is turned off with a loosening of said rope eliminated by manipulating it for normal rotation, the drum is firmly kept at rest by means of engagement of said changeover ratchet wheel 26 with said ratchet 15 as either said notch 28*a* or 28*b* of said changeover ratchet wheel 26 is caught by said pawl 39. Rotation of said main shaft is not effected by said electric motor 5. Thus, said rope can be firmly retained while a boat is at rest.

We claim:

1. An anchor winch comprising:

(i) a support structure (ii) a winding drum journalled in said structure for rotation about an axis and having a coaxial drive pinion (iii) a reversible motor carrier by said structure and having a drive shaft with a quick-thread thereon (iv) a ratchet gear coaxial with said drive shaft and coupled to said drive pinion (v) a change-over ratchet wheel mounted coaxially on the quick thread of the drive shaft, said wheel having means at one axial end to engage a stop carried by the support structure, said wheel having means at the other axial end to engage with said ratchet gear, whereby upon rotation of said drive shaft in one direction said changeover ratchet wheel is thrust by said quick-thread in one axial direction to engage said stop and disengage from said ratchet gear, and upon rotation of said drive shaft in the other direction said changeover ratchet wheel is thrust by said quick thread in the other axial direction to disengage from said stop and engage with said ratchet gear, (vi) a feed cam shaft journalled in said support structure for rotation about an axis parallel to said axis of the drum, (vii) a cam-follower rope guide engaged on said feed cam shaft for reciprocal axial traversing movement as said cam shaft is rotated, and (viii) means rotationally coupling said feed cam shaft and winding drum drive pinion.

2. An anchor winch, as claimed in claim 1, comprising:

(a) a brake means, to act on said drum, including an operating member, (b) a rope rider carried in vertically movable manner by said rope guide and positioned above said operating member, said rope rider being held out of contact with said operating member when said rope is under tension, but upon reduction of tension in the rope said rider falling by gravity to contact and operating member and brake said drum.

* * * * *